United States Patent [19]

Fox

[11] 4,334,667

[45] Jun. 15, 1982

[54] HYDRAULIC RELEASE SYSTEM FOR LIFTING JACK

[75] Inventor: Robert Fox, Wilmington, Calif.

[73] Assignee: Norco Industries, Inc., Gardena, Calif.

[21] Appl. No.: 166,238

[22] Filed: Jul. 7, 1980

[51] Int. Cl.[3] ..... B66F 3/00

[52] U.S. Cl. ..... 254/8 B; 251/251

[58] Field of Search ..... 254/8 B, 8 R, 2 B, 2 R; 251/251, 263, 213

[56] References Cited

U.S. PATENT DOCUMENTS

| | | | |
|---|---|---|---|
| 3,656,709 | 4/1972 | Shufflebarger et al. | 251/263 |
| 3,757,612 | 9/1973 | Schaefer | 251/263 |
| 4,277,048 | 7/1981 | Okuda | 254/8 B |

*Primary Examiner*—Robert C. Watson

*Attorney, Agent, or Firm*—Vernon D. Beehler

[57] ABSTRACT

A low-slung carriage-mounted lifting jack has a long tubular handle for projecting the jack beneath a conventional automotive vehicle. The handle is tiltably mounted on the carriage and simultaneously serves as a pump handle for pumping hydraulic fluid from a reservoir to a ram which in turn is operatively attached to an elevating linkage for lifting the vehicle. A pump, for operation of which the handle is tiltably mounted on the carriage, delivers hydraulic fluid under pressure from the reservoir to the ram. To release hydraulic pressure in the ram, for lowering the linkage and returning the fluid to the reservoir, there is a release valve with a release pin projecting adjacent the end of the handle which is tiltably mounted on the carriage. Within the handle is a rotatably mounted rod extending throughout the length of the handle, and on the end of the rod is a cam in operating engagement with the release pin. The cam moves the release pin to release, or lowering, position from which it is returned by hydraulic pressure when the cam action is discontinued.

6 Claims, 13 Drawing Figures

HYDRAULIC RELEASE SYSTEM FOR LIFTING JACK

Lifting jacks, or as they are frequently termed, floor service jacks, have been in widespread use in garages and service stations for a considerable period of time. Such jacks have been improved from time to time as evidenced by the structure of U.S. Pat. Nos. 4,018,421 and No. 4,131,263. These jacks are of a type adapted to be slid under the axle of a car, truck, or comparable vehicle by use of a long handle which subsequently serves as a pump handle for a hydraulic circuit.

Heretofore such jacks have been more commonly used in garages rather than by individual automobile owners. Improvements resulting in more compact and lighter weight devices have encouraged their use to a degree by owners of automobiles and trucks which have sufficient stowage capabilities. The progressive and dramatic increase in popularity of compact and sub-compact automobiles with diminishing stowage capabilities have made even the improved lifting jacks often unacceptable for such use. Cost also has become a far more serious objection as inflation has forced material and labor costs continually higher.

Great strides in ruggedness and simplicity have been achieved by the patents identified above which make use of a unitary oil block serving as a spacer for side plates and accommodating the entire hydraulic system and related hydraulic ram, pump cylinder and valves. There have, however, been too many machining operations and variety of parts to be able to hold the cost of manufacture down to a level permitting widespread use for the small compact and sub-compact automobiles.

It is therefore among the objects of the invention to provide a new and improved lifting jack of the floor service type which retains the ruggedness of the unitary oil block type of chassis heretofore popular, but wherein the number of machining operations and number of parts has been appreciably reduced at a corresponding saving.

Another object of the invention is to provide a new and improved lifting jack of the floor service type which, in addition to cutting down on the number of individual parts and fabricating operations, maintains the capability of releasing hydraulic pressure by a release machanism in the pump handle so that the jack can be effectively lowered no matter how far it may be positioned beneath an automotive vehicle.

Still another object of the invention is to provide a new and improved lifting jack of the floor service type in which the jack can be released for lowering irrespective of the position of the handle which serves a multiple purpose namely as a manipulating handle, a pump handle, and a hydraulic release, irrespective of how far the jack may be projected beneath the vehicle.

Still further among the objects of the invention is to provide a new and improved lifting jack of the floor service type which, by reason of cutting down on the number of parts and fabricating operations, makes possible manufacturing and assembling such jacks in the domestic area and at a price which is within reach of the average motorist, while at the same time avoiding sacrifice of ruggedness and durability.

With these and other objects in view, the invention consists of the construction, arrangement, and combination of the various parts of the device serving as an example only of one or more embodiments of the invention, whereby the objects contemplated are attained, as hereinafter disclosed in the specification and drawings, and pointed out in the appended claims.

FIG. 3 is a fragmentary longitudinal sectional view on the line 5—5 of FIG. 4.

FIG. 6 is a cross-sectional view on the line 6—6 of FIG. 5.

FIG. 7 is a fragmentary sectional view on the line 7—7 of FIG. 6, showing one position of the release cam.

FIG. 8 is a fragmentary sectional view similar to

Figures 5, 6, 7, 8:
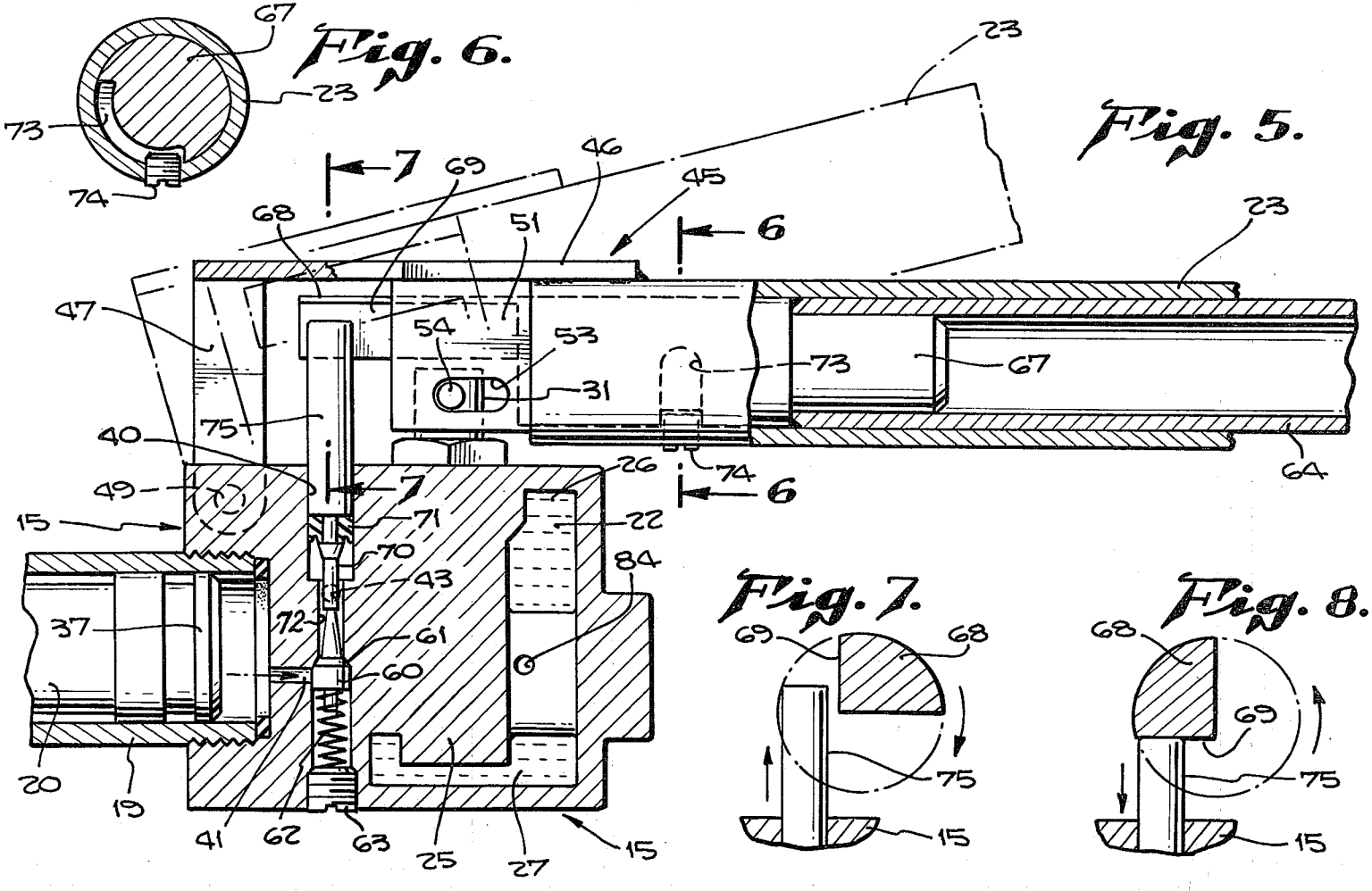

FIG. 7, showing the release cam in released position.

Figure 9:
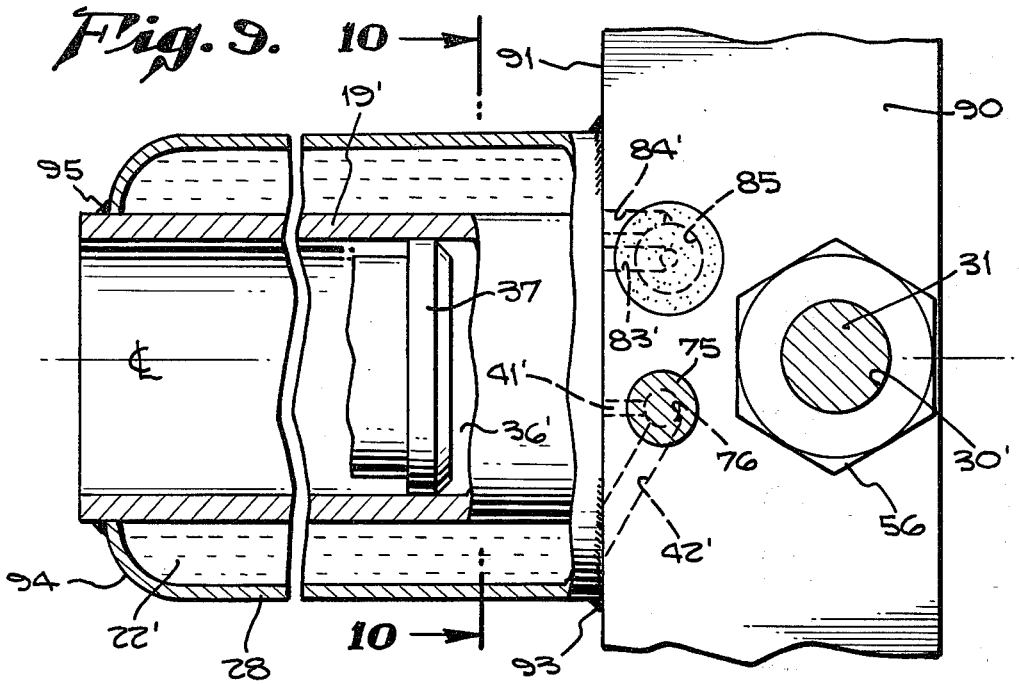

FIG. 9 is a plan view partially in section of a second form of the invention.

Figure 10:
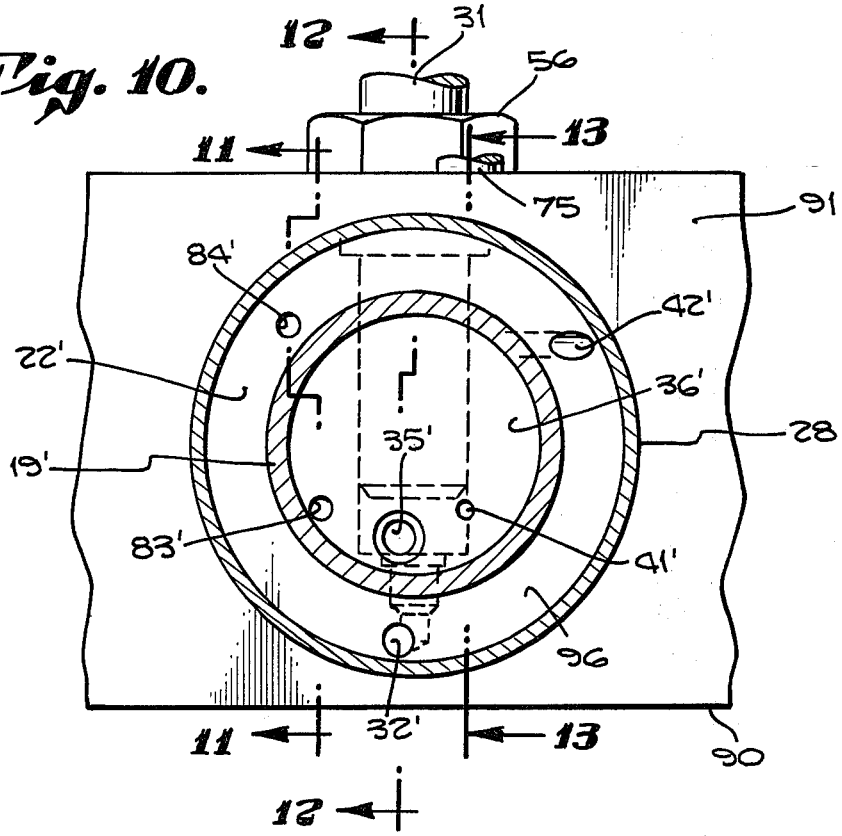

FIG. 10 is a cross-sectional view on the line 10—10 of FIG. 9.

Figure 11:
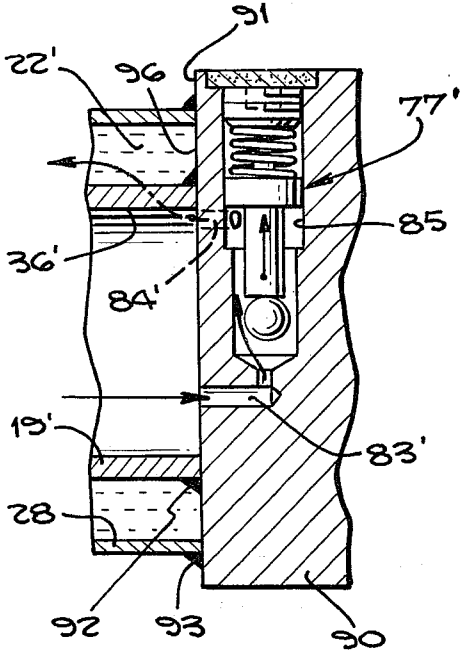

FIG. 11 is a fragmentary longitudinal sectional view on the line 11—11 of FIG. 10.

Figure 12:
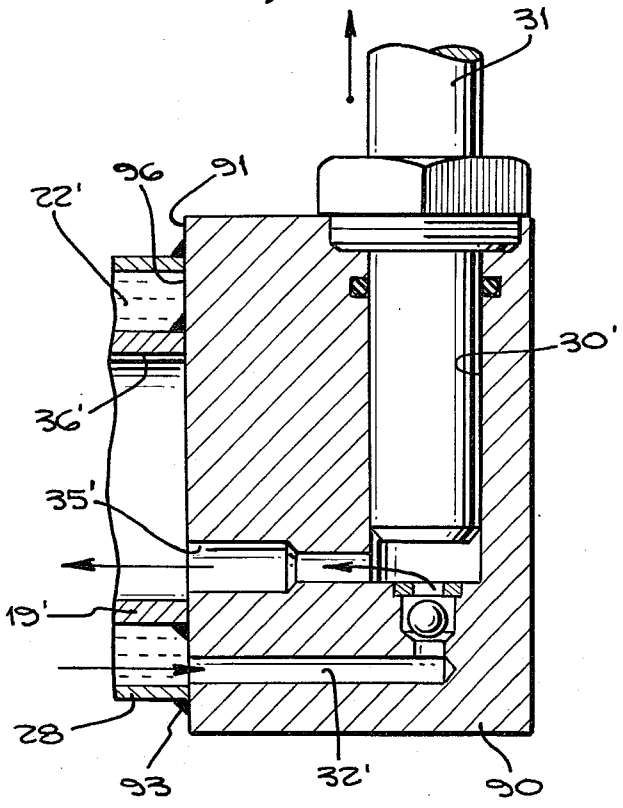

FIG. 12 is a fragmentary longitudinal sectional view on the line 12—12 of FIG. 10.

Figure 13:
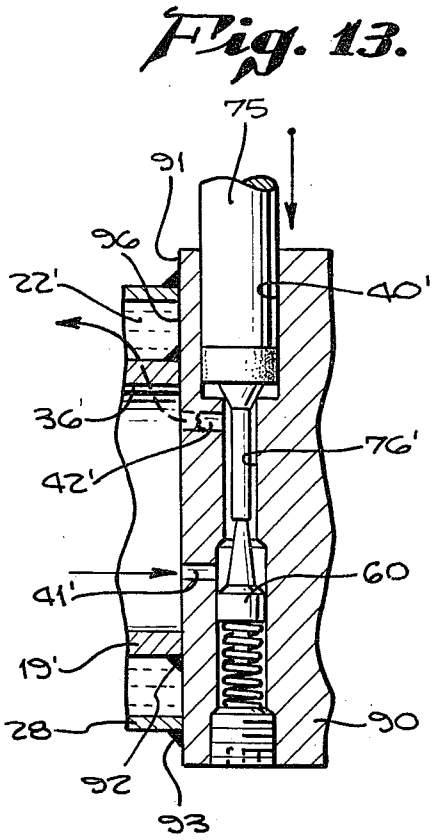

FIG. 13 is a fragmentary longitudinal sectional view on the line 13—13 of FIG. 10.

Figure 1:
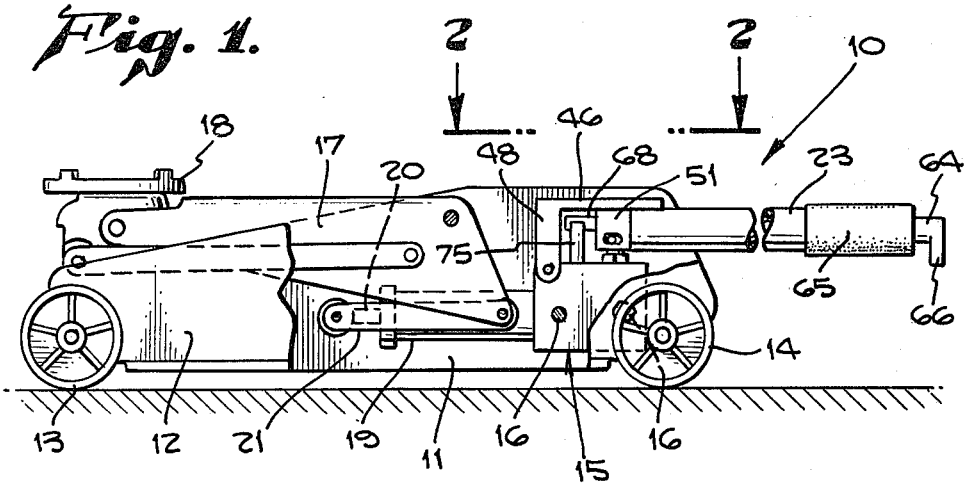
FIG. 1 is a side elevational view of the entire lifting jack showing the elevating linkage in lowered position.
Figure 2:
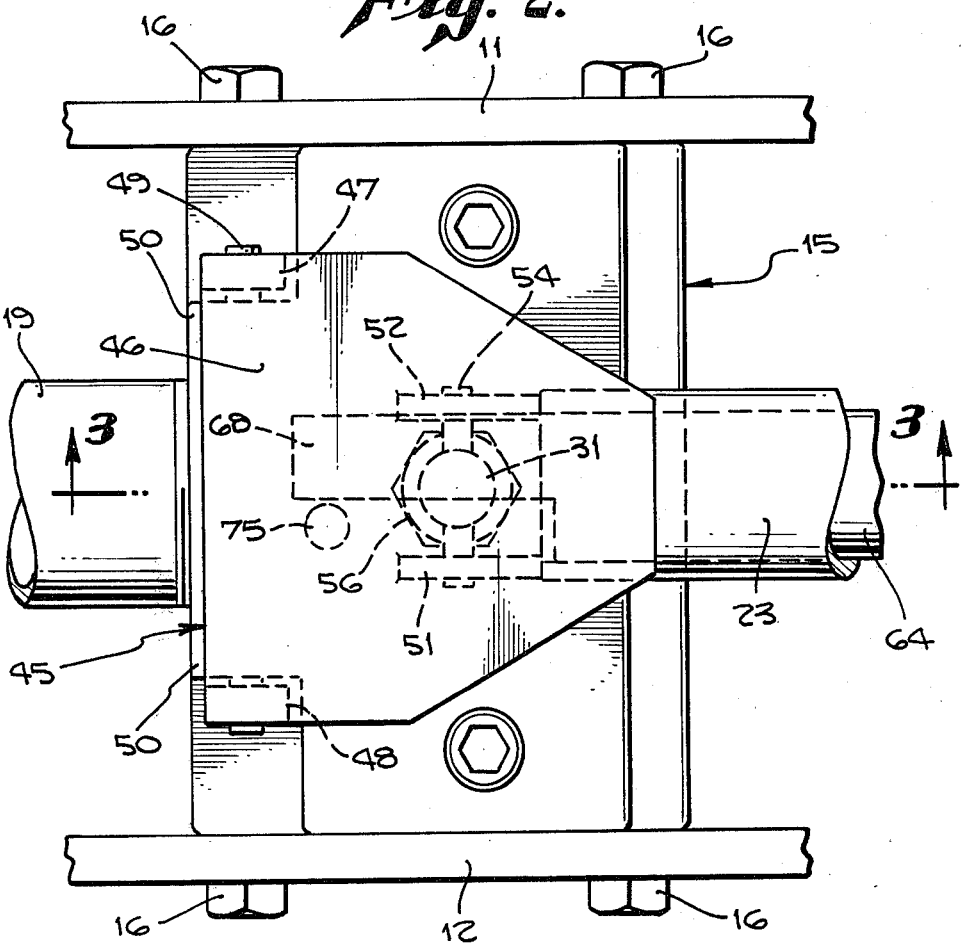
FIG. 2 is a fragmentary plan view on the line 2—2 of FIG. 1.
Figure 3:
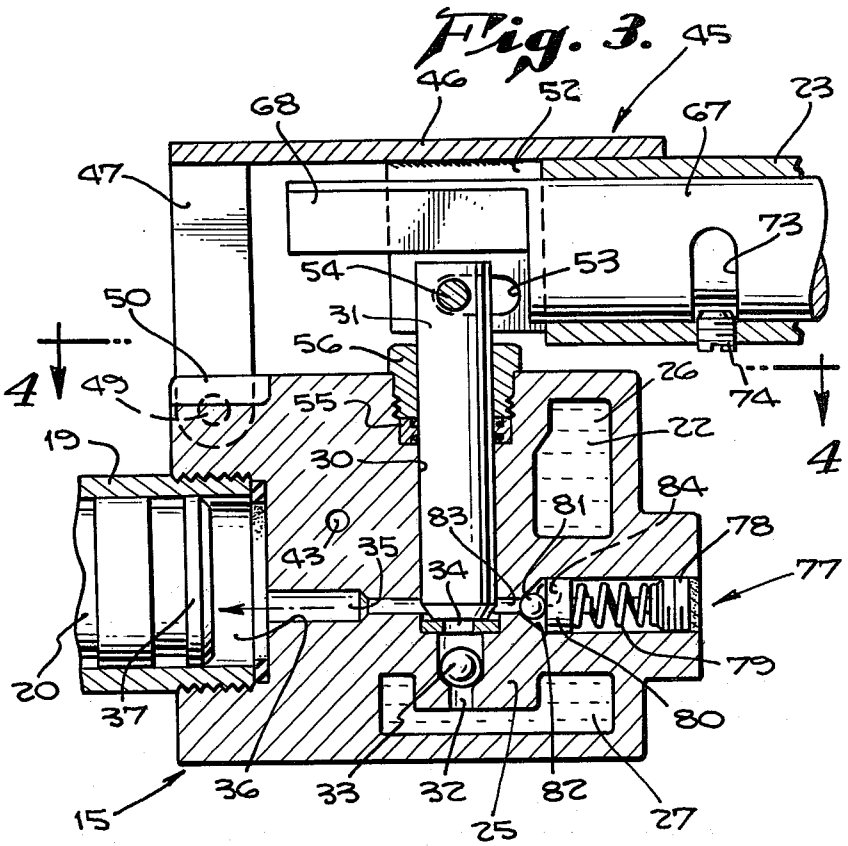
FIG. 3 is a fragmentary longitudinal sectional view on the line 3—3 of FIG. 2.
Figure 4:
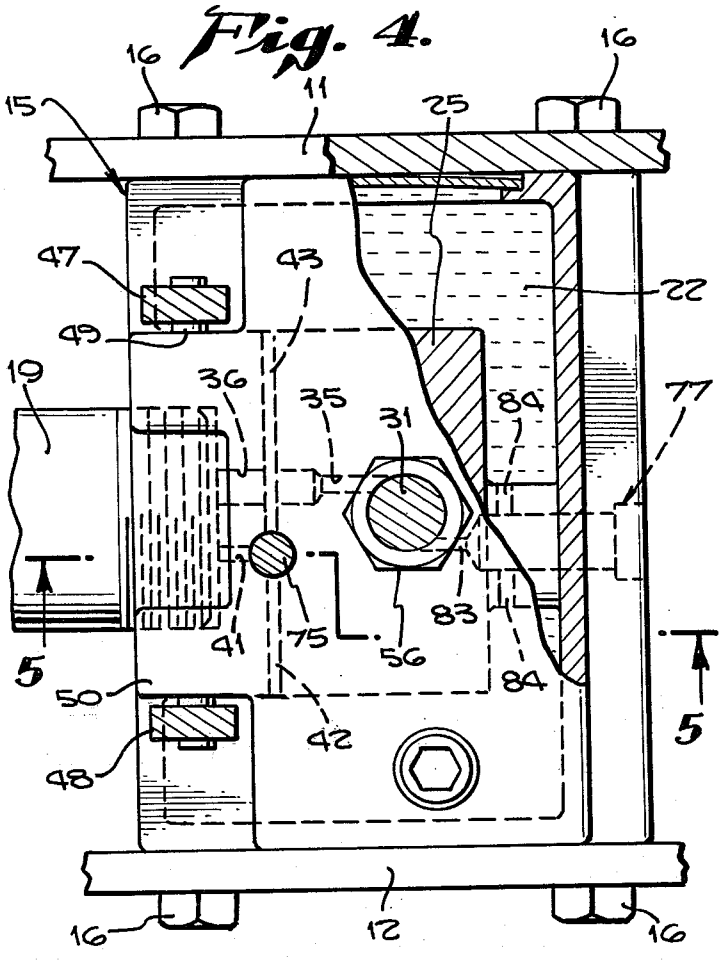
FIG. 4 is a fragmentary cross-sectional view on the line 4—4 of FIG. 3.

In one embodiment of the invention chosen for the purpose of illustration, a lifting jack 10 of the floor service type is shown in FIG. 1. Following substantially conventional construction, the lifting jack includes a frame or chassis consisting of side plates 11 and 12 which is supported by four wheels, of which the wheels 13 and 14 appear in FIG. 1. The side plates are tied together in spaced relationship by use of a unitary block 15 and bolts 16. To perform the lifting operation, there is provided an elevating linkage 17 pivotally mounted on the frame for operation between the side plates 11 and 12, the elevating linkage being provided with a lifting platform 18. Hydraulic lifting power is supplied to the elevating linkage by use of a hydraulic cylinder 19, a piston rod 20 of which connects to links 21 of the elevating linkage. The unitary block 15 similar to those heretofore in service serves a multiple purpose in that, in addition to providing a structural expedient, it also supports a hydraulic oil reservoir and provides a mounting for the hydraulic cylinder 19, a structure for the hydraulic valving and hydraulic system, and an attachment for a handle 23. Although the hydraulic cylinder 19 is here shown with a threaded attachment to the oil block 15, other means of attachment can be provided as, for example, friction welding. In the form of invention of FIGS. 1 through 6, a reservoir 22 is within the block 15. In the form of invention of FIGS. 9 through 13, a reservoir 22' is contained in a tubular reservoir housing 28.

Taking full advantage of the breadth and dimensions of the block 15, the reservoir 22 extends almost the entire distance between opposite side plates 11 and 12 except for provision of a structural partition 25, there being provided passageways 26 and 27 through the partition to interconnect opposite sides of the reservoir 22.

To provide hydraulic pressure in the hydraulic fluid to supply the hydraulic cylinder 19, there is a pump consisting essentially of a pump cylinder 30 in the partition 25 in which a piston 31 reciprocates. When the piston is reciprocated, as it moves upwardly, oil is drawn from the reservoir 22 in the area of the passageway 27, through a port 32, passing a ball check 33, and thence through a port 34 into the bottom of the pump cylinder 30. When the piston 31 moves downwardly, oil is forced through a high pressure passage 35 into a chamber 36 of the hydraulic cylinder 19 where, acting upon a piston head 37, it causes th piston rod 20 to be extended to activate the elevating linkage.

When the elevating linkage is to be lowered, high pressure oil in the chamber 36 is released through a release valve mechanism, indicated generally by the reference character 40. More particularly oil flows from the chamber 36 through a release passage 41 (see FIGS. 4 and 5) which, after passing through the release valve mechanism, is returned to the reservoir 22 by means of two return passages 42 and 43.

Of special interest in the present invention is the combined activity of the handle 23 which serves simultaneously as a means for manipulating the lifting jack beneath the chassis of automotive vehicles, a pump handle for manipulating the elevating linkage and a release for enabling the elevating linkage to lower. In serving such a multiple purpose, the pump handle is mounted upon a yoke 45, consisting of a plate 46 and flanges 47 and 48. The flanges in turn are pivotally mounted by means of a pivot pin 49 on a portion 50 of the oil block 15.

For manipulating the pump piston 31, two ears 51 and 52, projecting downwardly from the lower face of the plate 46, are provided with corresponding slots 53 through which passes a pin 54. The pin projects laterally through the upper end of the piston 31 which, as previously made reference to, reciprocates in the pump cylinder 30, in which there is provided a seal ring 55 and an appropriate packing nut 56. As the handle 23 is reciprocated up and down, pivoting about the horizontal pivot pin 49, the ears 51 and 52 reciprocate the piston 31 of the pump cylinder 30.

During the pumping action which forces hydraulic fluid under pressure into the chamber 36, passage of the hydraulic fluid through the release passage 41 is blocked by a release needle valve element 60, as shown in FIG. 5. The valve element is held in an upwardly directed seated position against a valve seat 61 by virtue of hydraulic fluid pressure in the release passage 41. A light spring 62 pressing against the underside of the valve element 60 and held there by a screw 63 is primarily for the purpose of positioning the valve element generally in its operative location.

For operating the release needle valve element, there is provided a rod 64 rotatably contained within the handle 23, the rod protruding from an outer end 65 of the handle where it is provided with a handhold 66. At the opposite end of the rod is a cylindrical plug 67 from which projects a cam 68. When the cam 68 is in the position of FIG. 7, which is the position applicable to the pumping mode and while the jack is in upwardly extended position, a release pin 75 is in its uppermost position, permitting the release needle valve element to remain seated. When the release needle valve is to be unseated, the cam 68 is rotated counterclockwise from the position of FIG. 7 to the position of FIG. 8. This causes a cam face 69 to be applied against the top of the release pin 75, pressing the pin downwardly against a plunger 70, there being provided a sealing ring 71 to block exit of the hydraulic fluid under pressure past the release pin 75. The plunger 70 then acts against the uppermost end of the release needle valve element 60, unseating it from the valve seat 61 to permit hydraulic fluid to flow from the chamber 36 through the release passage 41, thence upwardly through a connecting passage 72, and from there through the return passages 42 and 43 to the reservoir 22.

It is of consequence that the longitudinal center line of the release pin 75 is located relatively close to the longitudinal center line of the pivot pin 49 thus to require the positioning of the cam face 69 at a corresponding location. As a consequence, there is relatively limited movement of the cam face 69 between different reciprocating positions of the handle 23. The cam face 69 has appreciable length so that, regardless of the tilt of the handle 23, the cam face will always be in operative position with respect to the upper end of the release pin 75. As a consequence, the elevating linkage can be lowered with the handle 23 in its highest position of tilt as well as when extended horizontally as shown by the solid lines in FIG. 5. Inasmuch as a 90-degree rotation is sufficient to move the cam face between the inoperative position of FIG. 7 and the operative position of FIG. 8, rotation of the cylindrical plug 67 and rod 64 is limited by provision of an arcuate groove 73 in the cylindrical plug 67 which is adapted to receive a set screw 74 extending through a conventional threaded opening in the handle 23 so that it projects into the groove 73. The set screw not only serves as a limit to rotation of the rod 64, but also serves to hold the rod in its position within the handle 23.

For safety purposes, there is provided a conventional pressure relief valve 77 operating in a chamber 85. The valve includes a screw 78 exerting pressure on a spring 79 and plunger 80 so as to seat a ball valve element 81 upon a valve seat 82. The pressure relief valve 77 is normally set so that should the maximum design pressure in the hydraulic fluid be exceeded, hydraulic fluid will escape through a relief passage 83, unseating the ball valve 81 and then returning through a relief passage extension 84 to the reservoir 22.

In the interest of further implementing the objective of simplicity the form of invention of FIGS. 9 through 13 institutes a substantially solid spreader and bracer unit block 90 in which the hydraulic oil reservoir is omitted. Instead there is the tubular housing 28, previously identified, which is mounted on a front face 91 of the block 90.

The tubular housing is of inside diameter substantially larger than the outside diameter of a hydraulic cylinder 19′ which is substantially the same as the cylinder 19 of the first described form of the invention. In practice it has been found that a tubular housing 28 of about 3″ inside diameter and $5\frac{1}{2}$″ long applied over the cylinder 19′ when about 2″ outside diameter provides the reservoir 22′ with a volume sufficient to operate the cylinder 19′ when it is about 6″ in length.

In the further interest of economy the cylinder 19′ is attached to the front face 91 of the block 90 by a friction weld junction 92. Similarly a friction weld junction 93 may be employed to attach the housing 28 to the same front face 91 at a location concentric with respect to the cylinder 19′.

Since the tubular housing 28 and cylinder 19′ form respective outside and inside walls of the reservoir 22′, the housing 28 is bull-nosed over to form an arcuate end wall 94 for the reservoir where it is sealed by a weld 95.

A part 96 of the front face 91 of the block 90 serves as the opposite end of the reservoir 22'.

As appearing in the drawings, a port 32' in communication with the reservoir 28 supplies hydraulic fluid to the pump cylinder 30' from which it is forced into the chamber 36' by pump action. A release valve mechanism 40' is activated by hydraulic fluid from the chamber 36' through a release passage 41', from which it is returned to the reservoir 22' through a return release passage 42' from a valve chamber 76'.

An overload pressure relief valve 77' is provided in a chamber 85. Hydraulic fluid from the chamber 36', when overloaded, flows through a relief passage 83' to the chamber 85 from which it returns to the reservoir 28 through a return relief passage 84'.

It should be observed that all the hydraulic passageways enter and leave the several chambers of the block by virtue of passageways drilled or otherwise formed in the block 90 from substantially exterior faces. All except one extend perpendicular to their respective face. Since the chambers also are merely extensions of the passageways all can be readily drilled in a simple operation from one direction, at an appreciable saving of machining time.

By virtue of the structure made reference to, the number of parts customarily employed for a lifting jack of the character under consideration can and have been materially reduced. The structure also is one of comparative simplicity which at the same time reduces materially the machining operations customarily necessary even in a unitary block expedient such as those heretofore employed. As has been noted, the handle 23 is an effective multi-purpose expedient. The breadth of the yoke 45 improves the ability of the handle to manipulate the entire lifting jack into position within the limited space frequently present under an automotive chassis. Action of the pump piston 31 is at a location such that there is appreciable distance between the axis of rotation of the yoke about the pivot pin 49 and the reciprocating center line of the piston 31 to provide a pumping stroke adequate for the purpose. At the same time, the cam action is sufficiently unique to be operable in any of the reciprocating positions of the handle. By reason of the extremely simple cam action and relative location of the release pin 75, an appreciable freedom of operation is allowable without the need for close machining and structural tolerances.

While a particular embodiment of the present invention has been shown and described, it will be obvious to those skilled in the art that changes and modifications may be made without departing from the invention in its broader aspects and, therefore, the aims of its appended claims are to cover all such changes and modifications as fall within the true spirit and scope of this invention.

Having described the invention, what is claimed as new in support of Letters Patent is as follows:

1. A hydraulic actuator system for a lifting jack wherein the lifting jack has a carriage including a block, a hydraulic reservoir supported by said block, a power ram in operating engagement with a lifting linkage and a pump between the reservoir and the ram having a reciprocating pump handle with a horizontal pivot axis tiltably mounting the pump handle on said carriage for operation throughout a range of positions in a vertical plane to activate the pump, said system comprising a hydraulic fluid return line from the ram to the reservoir, a valve seat in said return line acting upstream relative to flow from the ram, a valve element adapted to engage said seat under pressure from said ram, a release pin reciprocatably mounted on said carriage and in operating engagement with said valve element, a manually actuated release member rotatably mounted on said pump handle, a cam element on said release member normally clear of engagement with said release pin throughout the range of positions of said pump handle and having progressively acting camming engagement positions with said release pin upon rotation of said release member throughout the range of positions of said pump handle whereby to effect controlled release of pressure in said ram to lower the elevating linkage.

2. A hydraulic actuator system as in claim 1 wherein the release pin and the cam element are located substantially at the pivot axis of the pump handle whereby to preserve the operating engagement of the cam with the release pin throughout said range of positions of the pump handle.

3. A hydraulic actuator system for a lifting jack wherein the lifting jack has a carriage including a block, a hydraulic reservoir supported by said block, a power ram in operating engagement with a lifting linkage and a pump between the reservoir and the ram having a reciprocating pump handle with a horizontal pivot axis tiltably mounting the pump handle on said carriage for operation throughout a range of positions in a vertical plane to activate the pump, said system comprising a hydraulic fluid return line from the ram to the reservoir, a valve seat in said return line acting upstream relative to flow from the ram, a valve element adapted to engage said seat under pressure from said ram, a release pin reciprocatably mounted on said carriage and in operating engagement with said valve element, a manually actuated release member rotatably mounted on said pump handle, a cam element on said release member having progressively acting camming engagement positions with said release pin throughout the range of positions of said pump handle whereby to effect controlled release of pressure in said ram to lower the elevating linkage, said manually actuated release member comprising a rod rotatably mounted on its long axis on said pump handle, said pump handle being tubular and the rod being located within and concentric with respect to said handle, there being stop means to limit rotation of said rod relative to said pump handle.

4. A hydraulic actuator system for a lifting jack wherein the lifting jack has a carriage including a block, a hydraulic reservoir supported by said block, a power ram in operating engagement with a lifting linkage and a pump between the reservoir and the ram having a reciprocating pump handle with a horizontal pivot axis tiltably mounting the pump handle on said carriage for operation throughout a range of positions in a vertical plane to activate the pump, said system comprising a hydraulic fluid return line from the ram to the reservoir, a valve seat in said return line acting upstream relative to flow from the ram, a valve element adapted to engage said seat under pressure from said ram, a release pin reciprocatably mounted on said carriage and in operating engagement with said valve element, a manually actuated release member rotatably mounted on said pump handle, a cam element on said release member having progressively acting camming engagement positions with said release pin throughout the range of positions of said pump handle whereby to effect controlled release of pressure in said ram to lower the elevating linkage, said manually actuated release member comprising a rod rotatably mounted on its long axis on said pump handle, the pump handle being tubular and the rod being located within and concentric with respect to said handle, a portion of the rod at the end adjacent the pivot axis of the pump handle being exposed relative to the pump handle, said cam element being cut from an integral portion of the rod.

5. A hydraulic actuator system for a lifting jack wherein the lifting jack has a carriage including a block, a hydraulic reservoir supported by said block, a power ram in operating engagement with a lifting linkage and a pump between the reservoir and the ram having a reciprocating pump handle with a horizontal pivot axis tiltably mounting the pump handle on said carriage for operation throughout a range of positions in a vertical plane to activate the pump, said system comprising a hydraulic fluid return line from the ram to the reservoir, a valve seat in said return line acting upstream relative to flow from the ram, a valve element adapted to engage said seat under pressure from said ram, a release pin reciprocatably mounted on said carriage and in operating engagement with said valve element, a manually actuated release member rotatably mounted on said pump handle, a cam element on said release member having progressively acting camming engagement positions with said release pin throughout the range of positions of said pump handle whereby to effect controlled release of pressure in said ram to lower the elevating linkage, said manually actuated release member comprising a rod rotatably mounted on its long axis on said pump handle, said pump comprising a plunger reciprocatably mounted in the block on an axis transverse to said pivot axis, said release pin being reciprocatably mounted in the block on an axis parallel to the axis of the plunger and the two axes being substantially in the plane of operation of said pump handle.

6. A hydraulic actuator system for a lifting jack wherein the lifting jack has a carriage including a block, a hydraulic reservoir supported by said block, a power ram in operating engagement with a lifting linkage and a pump between the reservoir and the ram having a reciprocating pump handle with a horizontal pivot axis tiltably mounting the pump handle on said carriage for operation throughout a range of positions in a vertical plane to activate the pump, said system comprising a hydraulic fluid return line from the ram to the reservoir, a valve seat in said return line acting upstream relative to flow from the ram, a valve element adapted to engage said seat under pressure from said ram, a release pin reciprocatably mounted on said carriage and in operating engagement with said valve element, a manually actuated release member rotatably mounted on said pump handle, a cam element on said release member having progressively acting camming engagement positions with said release pin throughout the range of positions of said pump handle whereby to effect controlled release of pressure in said ram to lower the elevating linkage, said manually actuated release member comprising a rod rotatably mounted on its long axis on said pump handle, said pump and said release valve being located in the block, said pump handle having its tiltable mounting on the block and the block being a spacer and anchoring connection between opposite spaced parallel plates comprising side walls of said carriage.

* * * * *